US009578952B1

(12) United States Patent
Wray

(10) Patent No.: US 9,578,952 B1
(45) Date of Patent: Feb. 28, 2017

(54) CONVERTIBLE BACKPACK AND GROUND COVER

(71) Applicant: Matthew C. Wray, Malad, ID (US)

(72) Inventor: Matthew C. Wray, Malad, ID (US)

( * ) Notice: Subject to any disclaimer, the term of this patent is extended or adjusted under 35 U.S.C. 154(b) by 33 days.

(21) Appl. No.: 14/684,381

(22) Filed: Apr. 11, 2015

Related U.S. Application Data

(60) Provisional application No. 61/978,442, filed on Apr. 11, 2014.

(51) Int. Cl.
*A45F 4/06* (2006.01)
*A45F 4/08* (2006.01)
*A45F 3/04* (2006.01)

(52) U.S. Cl.
CPC *A45F 3/04* (2013.01); *A45F 4/06* (2013.01); *A45F 4/08* (2013.01)

(58) Field of Classification Search
CPC ..... A45F 4/02; A45F 4/04; A45F 4/06; A45F 4/08; A45F 4/10; A45F 4/12; A45F 2004/023; A45F 2004/026; A45F 2003/025; A45F 3/04
USPC ..... 224/153–156, 578–580
See application file for complete search history.

(56) References Cited

U.S. PATENT DOCUMENTS 4,515,300 A * 5/1985 Cohen ..... A45C 1/04 224/153
5,346,308 A * 9/1994 Buhot ..... A45C 3/10 224/153
5,785,219 A * 7/1998 Kraft ..... A45F 4/02 2/66
6,393,638 B1 * 5/2002 MacColl ..... A45F 4/02 383/4
2005/0236450 A1 * 10/2005 Iannini ..... B63B 35/7946 224/577
2008/0054032 A1 * 3/2008 Jones ..... A45F 4/06 224/156
2010/0059558 A1 * 3/2010 Robinson ..... A41D 3/08 224/155

* cited by examiner

*Primary Examiner* — Justin Larson
*Assistant Examiner* — Scott McNurlen
(74) *Attorney, Agent, or Firm* — Rodney J. Fuller; Booth Udall Fuller, PLC

(57) ABSTRACT

A convertible ground cover configured to be able to convert into a backpack and revert to a ground cover. The convertible ground cover and backpack may be utilized in a variety of outdoor settings like hunting, camping, or fishing. The convertible ground cover and backpack allows users to quickly convert a ground cover into a backpack using minimal tools and can be performed under various conditions. This eliminates the unnecessary extra weight required in conventional systems of carrying both a backpack and a groundcover. Furthermore, the convertible ground cover and backpack may be easily cleaned during or after use.

15 Claims, 16 Drawing Sheets

CONVERTIBLE BACKPACK AND GROUND COVER

CROSS-REFERENCE TO RELATED APPLICATIONS

This application claims the benefit of U.S. Provisional Application No. 61/978,442 filed Apr. 11, 2014, which is hereby incorporated by reference in its entirety.

TECHNICAL FIELD

Aspects of this document relate generally to outdoor groundcovers and backpacks.

BACKGROUND

Ground covers are commonly used outdoors for camping, hunting, and the like. For example, ground covers are regularly used during gutting and cleaning of an animal during hunting. Carrying a ground cover and the necessary gutting and cleaning tools is often burdensome and inefficient to hunters and outdoorsmen. A solution is needed to minimize the gear carried and increase the utility of the items a hunter or outdoorsman carries.

Applicants believe that the material incorporated above is "non-essential" in accordance with 37 CFR §1.57, because it is referred to for purposes of indicating the background of the disclosure or illustrating the state of the art. However, if the Examiner believes that any of the above-incorporated material constitutes "essential material" within the meaning of 37 CFR §1.57(c)(1)-(3), applicants will amend the specification to expressly recite the essential material that is incorporated by reference as allowed by the applicable rules.

SUMMARY

Aspects of this document relate generally to a convertible ground cover and backpack that provides a sports or outdoor enthusiast the ability to convert a ground cover into a backpack and vice versa.

Particular implementations of a convertible ground cover and backpack may include one or more of the following.

In one embodiment, the convertible backpack comprises a tarp configured to be converted into a backpack. The tarp preferable has a first, second, and third fold line. The second and third fold lines are substantially parallel to each other and the second and third fold lines are substantially orthogonal to the first fold line. The convertible backpack also typically has a first fastener coupled to a first corner of the folded tarp; a second fastener coupled to a second corner of the folded tarp; a first shoulder strap having a distal portion coupled to the first fastener and a proximate portion coupled to the second fastener. The convertible backpack also preferable has a first pocket defined by the first, second, and third fold lines.

In certain embodiments, the backpack has a connecting element coupled to the tarp. The connecting element is preferably configured to couple with a waist belt.

In yet another embodiment, the backpack has at least two connecting elements. The connecting elements are typically straps having distal and proximate portions fixedly attached to the tarp. Optionally, the backpack can have a third fastener coupled to a third corner of the folded tarp and a fourth fastener coupled to a fourth corner of the folded tarp. In certain embodiments that convertible backpack has a second shoulder strap having a distal portion coupled to the third fastener and a proximate portion coupled to the fourth fastener.

The tarp may further include a first and fourth edge substantially parallel to the first fold line; a second and third edge substantially parallel to the second and third fold lines, wherein the second edge is proximate the second fold line, and the third edge is proximate the third fold line; and a plurality of grommets located proximate at least two of the first, second, third, or fourth edges.

In another aspect of the invention, the backpack has a first restraint fixedly attached to the tarp proximate the first corner, wherein the first fastener is coupled to the first restraint and a grommet proximate the first corner; and a second restraint fixedly attached to the tarp proximate the third corner, wherein the second fastener is coupled to the second restraint and a grommet proximate the third corner. The backpack may be configured such that the first and second restraints comprise straps having distal and proximate portions fixedly attached to the tarp and/or include a carry bag coupled to the tarp proximate the first, second, third, or fourth edges, wherein the carry bag has an internal volume of less than 1.0, 0.8, 0.6 or 0.5 cubic feet. The carry bag is configured to house the tarp.

Advantageously the backpack may include a connecting element coupled to the carry bag, the connecting element being configured to couple with a waist belt. The backpack may also further include a second pocket defined by the first fold line, the third fold line, and the third edge; and a third pocket defined by the first fold line, the second fold line, and the second edge.

In a different embodiment, the convertible backpack includes a tarp configured to be folded along a first, second, and third fold line such that, when folded, the tarp comprises: a first corner and a second corner proximate the first fold line, a fourth corner and the first corner proximate the second fold line, and a third corner and the second corner proximate the third fold line. Typically the tarp has first restraint fixedly attached to the tarp proximate the first corner; a second restraint fixedly attached to the tarp proximate the second corner; a plurality of grommets fixedly attached to the tarp; a first fastener coupled to the first restraint and a grommet proximate the first corner; a second fastener coupled to the second restraint and a grommet proximate the second corner; a third fastener coupled to at least two grommets proximate the third corner; a fourth fastener coupled to at least two grommets proximate the fourth corner; a first shoulder strap having a distal portion coupled to the first fastener and a proximate portion coupled to the third fastener; and a second shoulder strap having a distal portion coupled to the second fastener and a proximate portion coupled to the fourth fastener.

The invention also includes a method of converting a tarp to a backpack. The method includes at least 4, 5, or 6 of the following steps: (1) folding the tarp along a first fold line, the tarp comprises: a first and fourth edge substantially parallel to the first fold line; a second fold line substantially orthogonal to the first fold line; a third fold line substantially parallel to the second fold line; a second and third edge substantially parallel to the second and third fold lines, wherein the second edge is proximate the second fold line, and the third edge is proximate the third fold line; and a plurality of grommets located proximate at least two of the first, second, third, or fourth edges; (2) folding the tarp along the third fold line, thereby bringing the third edge proximate the second fold line, and placing a portion of the tarp beneath a first restraint; (3) folding the tarp along the second fold line, thereby bringing the second edge proximate the third fold line, and placing a portion of the tarp beneath a second restraint; (4) coupling a first fastener to the first restraint and a grommet; (5) coupling a second fastener to the second restraint and a grommet; (6) coupling a third fastener to at least two grommets proximate the third fold line and the first, second, and fourth edges; and (7) coupling a fourth fastener to at least two grommets proximate the second fold line and the first, third, and fourth edges.

In certain embodiments, the method may also include at least one of the following steps: coupling a first shoulder strap having a distal portion coupled to the first fastener and a proximate portion coupled to the third fastener; and coupling a second shoulder strap having a distal portion coupled to the second fastener and a proximate portion coupled to the fourth fastener.

In a particular embodiment, the method can be used to fold the tarp into a hammock. The method including the step of folding the tarp along the first fold line, coupling a fifth fastener to a first connector and at least two grommets proximate the second edge, and coupling a sixth fastener to a second connector and at least two grommets proximate the third edge.

Aspects and applications of the disclosure are described below with reference to the DRAWINGS and the DETAILED DESCRIPTION. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those of ordinary skill in the art from the DETAILED DESCRIPTION, DRAWINGS, and the CLAIMS.

BRIEF DESCRIPTION OF THE DRAWINGS

Implementations will hereinafter be described in conjunction with the following DRAWINGS (which are not necessarily to scale), where like designations denote like elements, and.

DETAILED DESCRIPTION

In the following description, reference is made to the accompanying DRAWINGS which form a part hereof, and which show by way of illustration possible implementations. Moreover, numerous specific details are set forth below in order to provide a thorough understanding of the various aspects of the disclosure. It will be understood, however, by those skilled in the relevant arts, that the present disclosure may be practiced without these specific details. In other instances, known structures and devices are shown or discussed more generally in order to avoid obscuring the disclosure. In many cases, a description of the operation is sufficient to enable one to implement the various forms of the disclosure. As a matter of convenience, various components will be described using exemplary materials, sizes, shapes, dimensions, and the like. However, this document is not limited to the stated examples and other configurations are possible and within the teachings of the present disclosure.

Various implementations and embodiments contemplated in this disclosure relate to a convertible ground cover and backpack. Disclosures presented herein may be utilized in a variety of settings, included but not limited to hunting, camping, fishing, or any other outdoor or indoor activities. According to some aspects, the convertible ground cover and backpack allows users to convert a ground cover into a backpack. This eliminates the unnecessary extra weight required in conventional systems of carrying both a backpack and a groundcover. Furthermore, the convertible ground cover and backpack may be easily cleaned during and after any of the outdoor activities disclosed herein.

Figure 1:
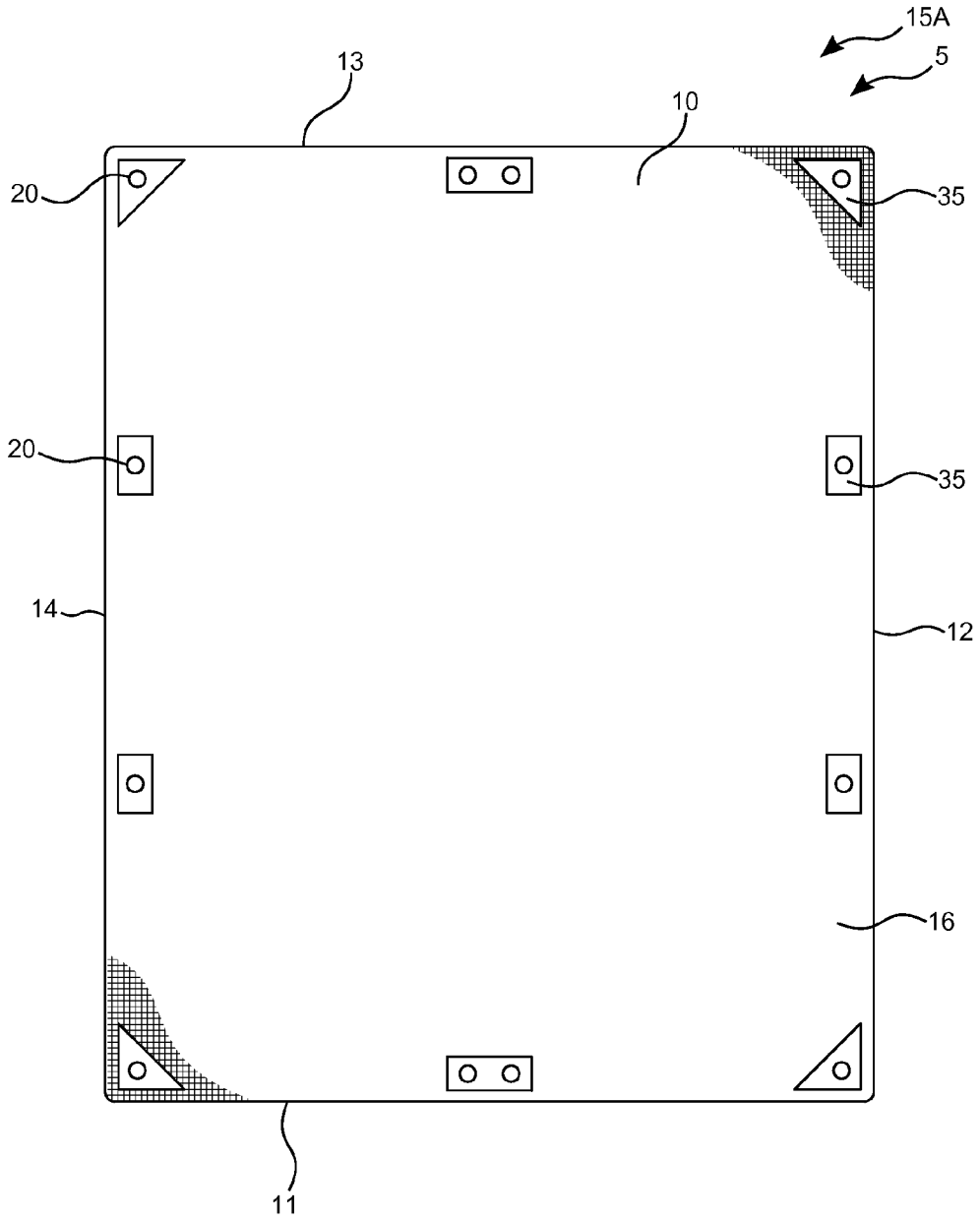
FIG. 1 illustrates a top-down view of the first side of a tarp of a convertible ground cover and backpack.
Figure 2:
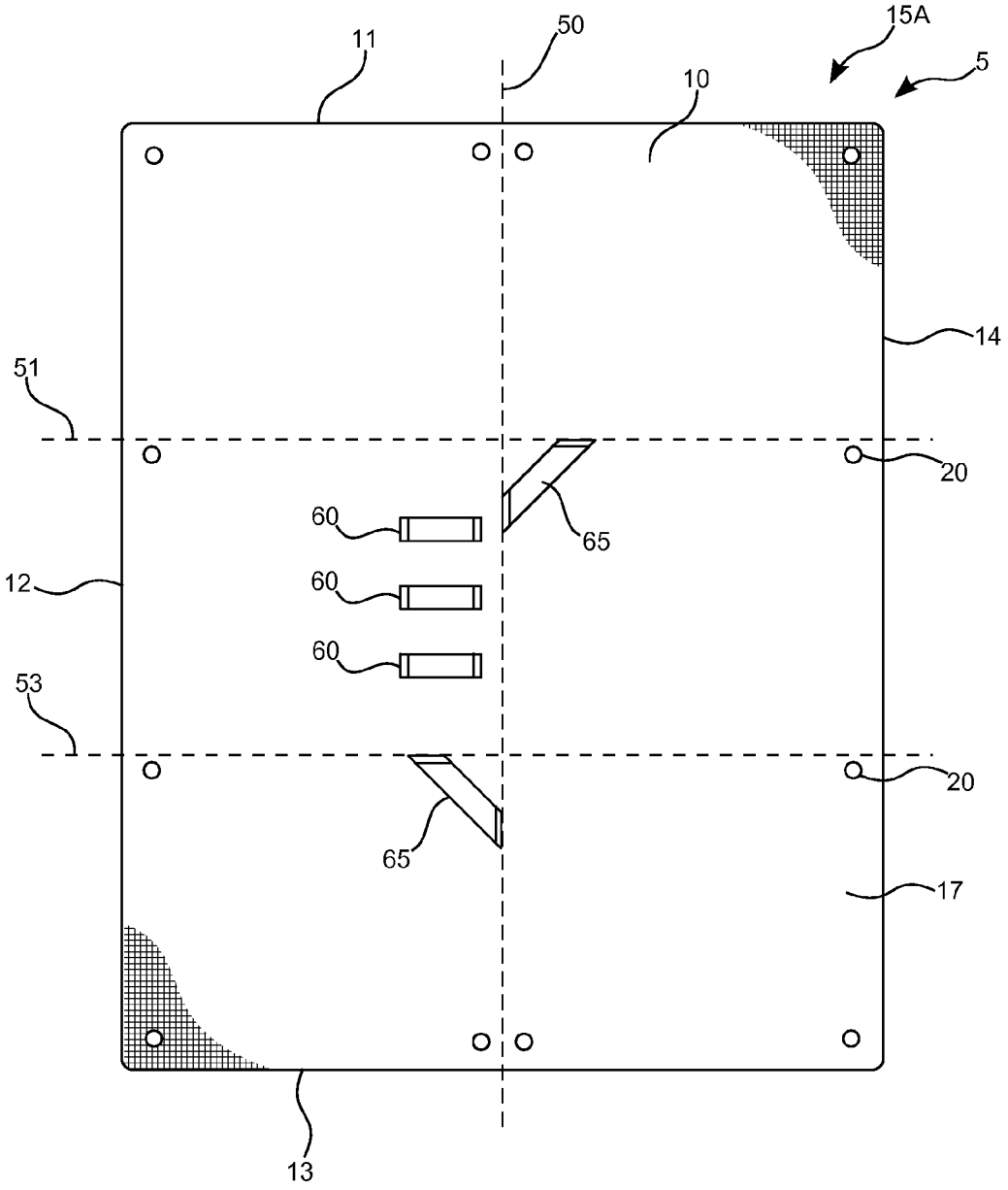
FIG. 2 illustrates a top-down view of the second side of a tarp of a convertible ground cover and backpack.
Figure 3:
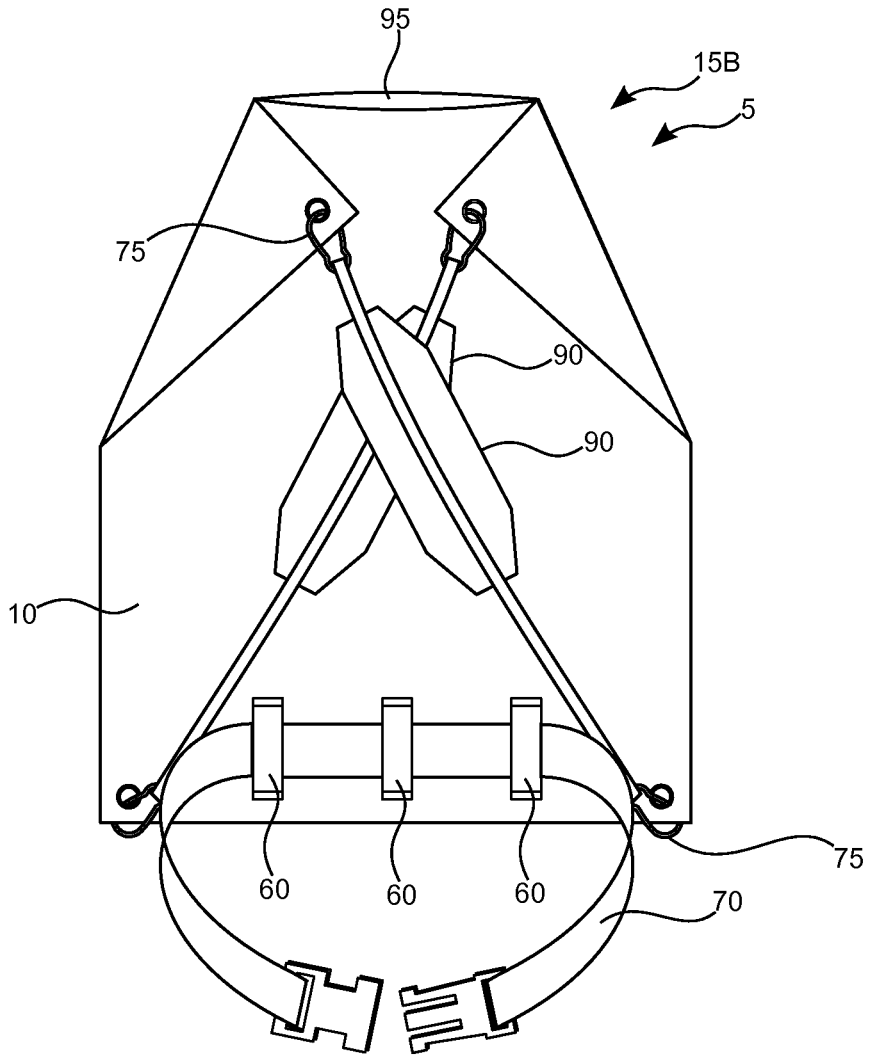
FIG. 3 illustrates a view of a backpack according to embodiments of a convertible ground cover and backpack.

FIGS. 1-3 depict various non-limiting embodiments of a convertible ground cover and backpack 5. Convertible ground cover and backpack 5 may be configured to be used as a ground cover 15A (see, e.g., FIGS. 1 and 2) or, as described herein, converted into a backpack 15B (see, e.g., FIG. 3). One or more embodiments of a convertible ground cover and backpack 5 comprises a tarpaulin 10 (also called "tarp 10"). FIG. 1 illustrates a top-down view of the first side 16 of tarp 10. FIG. 2 illustrates a top-down view of the second side 17 of tarp 10. FIG. 3 illustrates a view of backpack 15B from the side worn next to a user's back. The tarp 10 may be configured in a variety of shapes and sizes, including but not limited to a square or rectangular tarp 10.

In implementations where tarp 10 is rectangular (and not a square rectangle), tarp 10 will have two short edges, edges 11 and 13, and two long edges, edges 12 and 14. Tarp 10 is folded along one or more fold lines (e.g., fold lines 50, 51, and 53) so that tarp 10 may convert from operating as a ground cover 15A to a backpack 15B having at least one pocket 95. Tarp 10 may include one or more connecting elements (e.g., waist belt straps 60) configured to couple with a waist belt 70 intended to be clasped around the user's waist during operation as backpack 15B. In operation as backpack 15B, one or two shoulder straps 90 are coupled to tarp 10 by coupling fasteners (e.g., carabiner 75) to grommets 20 and shoulder strap(s) 90.

Figure 4:
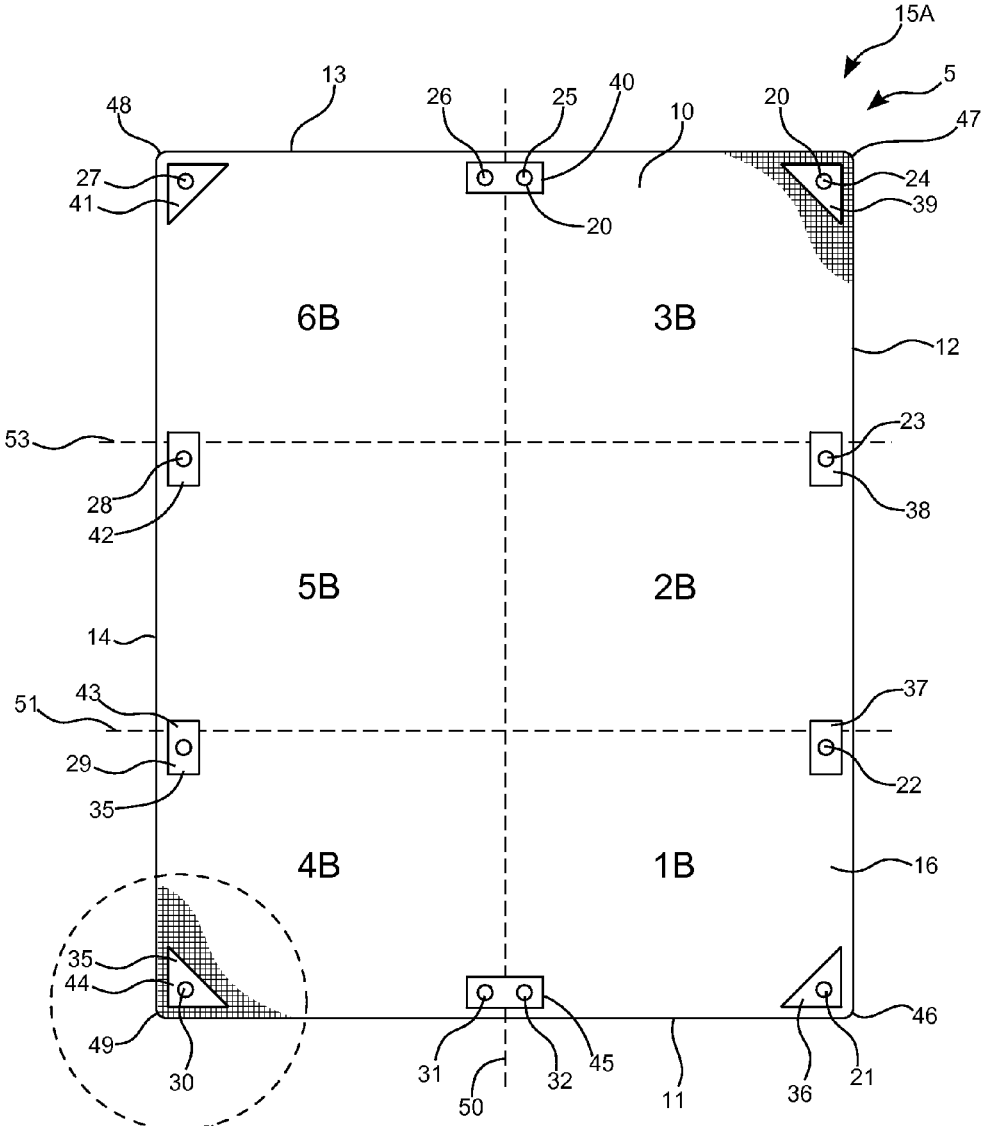
FIG. 4 provides a more detailed view of the implementations of FIG. 1.
Figure 5:
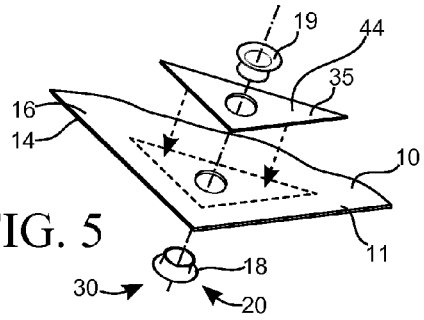
FIG. 5 depicts an exploded call-out view showing various aspects of the construction of grommets according to the implementations of FIG. 4.
Figure 6:
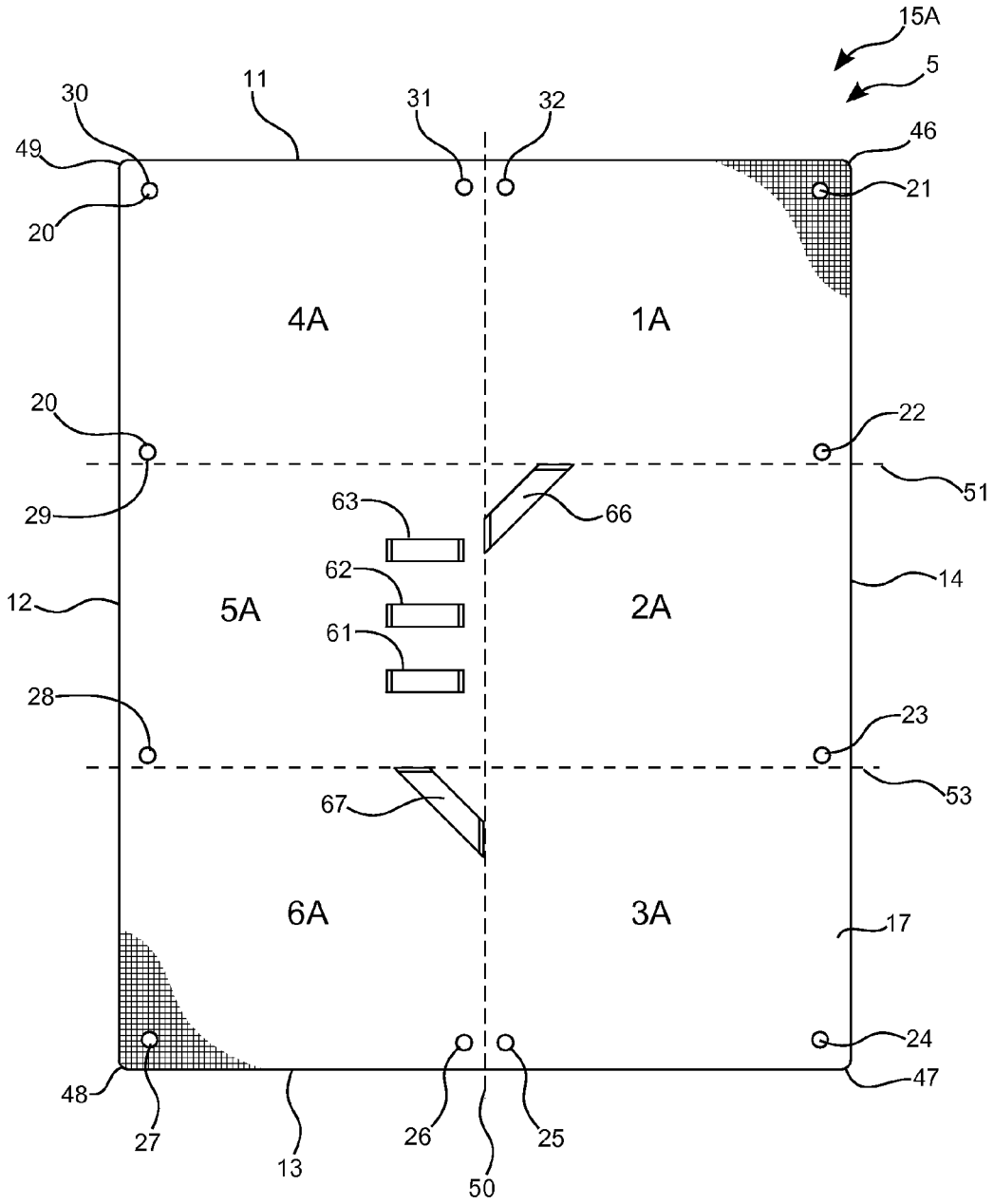
FIG. 6 provides a more detailed view of the implementations of FIG. 2.

Referring now to FIGS. 1-6, FIG. 4 provides a more detailed view of FIG. 1, FIG. 6 provides a more detailed view of FIG. 2, and FIG. 5 depicts a call-out view of some implementations of constructing a grommet 20 to couple with tarp 10. In one, non-limiting embodiment, the tarp 10 comprises a 68" by 58" inch heavy gauge tear resistant nylon. In some embodiments, tarp 10 has an area of about 10 to 150 square feet, 8 to 70 square feet, 15 to 45 square feet, or 24 to 30 square feet. For example, embodiments having a rectangular shaped tarp 10 may have a variety of rectangular dimensions, including but not limited to: 60" by 60", 60" by 72", 44" by 62", 80" by 50", 144" by 84", 70" by 36", 60" by 96", or 60" by 84". Any reference to particular dimensions of the tarp 10 or other aspects of a convertible ground cover and backpack 5 disclosed herein are by way of example only and not limitation. For example, convertible ground cover and backpack 5 in some embodiments tarp 10 may have a shape that is circular, elliptical, oblong, irregular, or a polygon having any number of sides capable of being manufactured (e.g., 3-15 sides or even more sides).

The material of the tarp 10 may comprise any suitable material known in the art, such as but not limited to polyethylene, polyester, canvas (such as cotton), or nylon. Water proofing or other coatings may be applied to the tarp 10, such as but not limited to a urethane coating, an ultraviolet light coating ("UVC"), and the like. More particular exemplary materials for tarp 10 may include but are not limited to 70 denier canvas; ripstop 200 denier canvas; 400 denier canvas; 500 denier canvas; 300/600 denier canvas; 600 denier canvas; 1000 denier canvas; and 200 ploy. In one non-limiting embodiment, the material for tarp 10 is 400 nylon and 300/600 poly. In another embodiment, the material for tarp 10 is 600 poly and 1000 nylon. Any reference to particular materials of the tarp 10 or other aspects of a convertible ground cover and backpack 5 disclosed herein are by way of example only and not limitation.

Tarp 10 has a first or inner side 16 according to the non-limiting embodiments of a convertible ground cover and backpack 5 shown in FIGS. 1-6. According to some aspects, tarp 10 comprises an edge 11, an edge 12, an edge 13, and an edge 14. Some embodiments may employ a tarp 10 having a (non-square) rectangular shape where two edges are longer than the other two edges, such as edges 12 and 14 being longer than edges 11 and 13 (see, FIGS. 1-2), or vice versa.

A convertible ground cover and backpack 5 typically further comprises a plurality of grommets 20 coupled to tarp 10, such as where each grommet 20 has a hole extending through tarp 10 and the axis of grommet 20. The plurality of grommets 20 may comprise any material known in the art, such as but not limited to metals, plastics, rubbers, and the like. Grommets 20 may be grommets, washers, teeth washers, neck washers, eyelets, and other reinforcing elements having a void near a central axis. Grommets 20 typically have a circular or ring shaped void (when viewed top-down), but the void may also be one of many polygons (e.g., square, hexagon, etc.) or have an oblong or irregular shape. In the non-limiting embodiment depicted in FIGS. 1-6, the grommets 20 comprise metal grommets. According to some aspects, each grommet 20 may extend not only through the tarp 10, but also through a support material 35 coupled to the tarp 10 adjacent the respective grommet 20. The support material 35 may comprise any material known in the art, such as but not limited to canvas, plastic, rubber, and the like. In some embodiments, support material 35 has a thickness greater than the thickness of tarp 10 and/or has a tensile strength greater than a corresponding area of tarp 10. In certain embodiments, support material 35 may be flexible or rigid and is primarily constructed of one or more of the following materials: rubber, polymer fabric, nylon, natural or synthetic leather, carbon fiber, metal, canvas, plastic, any material disclosed for possible use in tarp 10, and so on. Support material 35 may couple to tarp 10 in various ways, including but not limited to: adhesives, stitching, bonding agents, crimping, welding, soldering, brazing, taping, gluing, cementing, magnets, heat bonding, lashings, grommets, fasteners, ties, clips, staples, and so forth.

In certain embodiments, convertible ground cover and backpack 5 is configured with one or more fold lines to assist the user in properly folding tarp 10 to convert from ground cover 15A mode to backpack 15B mode. For example, tarp may include fold lines 50, 51, and 53, and may allow tarp 10 to be folded into six sections. Those skilled in the art can recognize that tarp 10 may be configured to fold in more or fewer sections with more or fewer fold lines. The fold lines may be for reference only and may or may not represent any physical structure. In some embodiments, fold lines (e.g., fold lines 50, 51, and 53) are identified for the user (e.g., printed or stitched lines), contain elements enhancing the flexibility of tarp 10 near the fold lines (e.g., rubber or flexible fabric), or contain elements enhancing the strength of tarp 10 near the fold lines (e.g., fabric, cable, or cord affixed to the fold lines).

To assist with the description of folding methods and the position of certain elements, six different sections (labeled 1A through 6A and 1B through 6B) are identified on tarp 10, as shown in FIGS. 4, 6-12, 14, and 16-17. These labeled sections are for reference and do not represent an element printed or coupled to tarp 10. Additionally, the sections can be labeled differently, more or fewer sections may be used, or the sections may align with fold lines, other elements of tarp 10, or be otherwise positioned. This disclosure will generally refer to these sections, by way of example only, as follows: section 2A, section 4B, section 5A, sections 3B and 6B, sections 4A-6A, sections 2A/2B, and so on.

Referring still to FIGS. 1-6 and in particular to FIGS. 4-6, the plurality of grommets 20 is typically positioned strategically to allow the tarp 10 to be converted from a ground cover 15A to a backpack 15B, and vice versa. According to some aspects, a grommet 20 positioned proximate each corner of the tarp 10, such as grommets 21, 24, 27, and 30 located at corresponding tarp corners 46, 47, 48, and 49. In these and other embodiments, the convertible ground cover and backpack 5 may further comprise one or more grommets 20 positioned proximate edge 14, edge 12, and each of edges 11 and 13, such as depicted by grommets 22, 23, 25, 26, 28, 29, 31, and 32. In some embodiments, grommets 20 are positioned proximate the outside edges of tarp 10, such as being positioned within six inches (or within 2.5, 4, 8, or 12 inches) of one or more of edges 11, 12, 13, or 14. In some embodiments grommets 20 are positioned proximate each other, such as grommets 25-26 and grommets 31-32 (e.g., positioned no more than 2, 3, 5, or 7 inches away from each other). In some embodiments grommets 20 are positioned separate from each other, such as grommets 21, 22, 23, 24, 27, 28, 29, and 30. In certain embodiments the axis of all grommets 20 coupled to tarp 10 are positioned approximately 0.5-5 inches, 1-4 inches, 2-3 inches, or 2.5 inches away from edges 11, 12, 13, and 14.

FIG. 5 depicts an exploded call-out view of FIG. 4 showing various aspects of the construction of grommets 20 according to some embodiments. Specifically, grommet 30 is shown for illustrative purposes, and primarily comprises a first part 18 and a second part 19. First part 18 may fixedly couple or attach to second part 19 through pressure or another coupling mechanism. In this example, first part 18 and second part 19 are constructed from sheet metal such as aluminum, steel or brass. Support material 35, or support material 44 in this example, is coupled to tarp 10 as depicted by the arrows, and surrounds grommet 20/30 so that at least a portion of support material 35/44 extends beyond the edge of grommet 20/30 (e.g., extending at least 1 cm, 3 cm, 5 cm, or further beyond). As grommet 20/30 intersects support material 35/44, the pressure from grommet 20/30 may assist in coupling support material 35/44 to tarp 10.

Referring now primarily to FIG. 6, one or more embodiments of a convertible ground cover and backpack 5 comprise one or more restraints or coupling straps, such as restraints 65, positioned to couple or capture folded corners of the tarp 10 when the tarp 10 is folded to convert from a ground cover 15A to a backpack 15B. The restraints 65 may be coupled to the tarp 10 with stitching, adhesives, and the like. According to some aspects, the two terminating ends of the restraints 65 are coupled to the tarp 10 such that an opening is formed between the restraint 65 and the tarp 10 between the two terminating ends of the restraint 65. For example, the two terminating ends of restraints 65 may be stitched or otherwise adhered to or coupled with tarp 10. While restraints 65 are utilized in the embodiment shown in FIG. 6, it is also contemplated that other couplings may be utilized, such as but not limited to additional grommets and carabiners, snap buttons, magnets, and the like.

Positioning of the restraints 65 may vary according to the particular implementation of the convertible ground cover and backpack 5. For reference, fold line 50 is positioned approximately central between, and approximately parallel to, edge 12 and edge 14. The fold line 50 extends between, and runs approximately orthogonal to, edges 11 and 13. According to some aspects, edge 12 is a top edge, edge 14 is a bottom edge, and edges 11 and 13 are side edges. Always by way of reference, fold line 51 and fold line 53 extend between, and runs approximately orthogonal to, edges 12 and 14. Fold line 51 and fold line 53 are positioned between, and approximately parallel to, edges 11 and 13. Fold line 51 and fold line 53 may be spaced at approximately equal distances from each other and their nearest side edge 11 or 13.

According to some aspects, a restraint 67 is positioned proximate an intersection of fold line 50 and fold line 53 and primarily within section 6A. More particularly, the restraint 67 is positioned to extend from approximately the fold line 50 to approximately the fold line 53, being primarily or entirely within section 6A.

According to some aspects, restraint 66 is positioned proximate an intersection of the fold line 50 and a fold line 51 of the two lateral lines and primarily within section 2A. More particularly, the restraint 66 is positioned to extend from approximately the fold line 50 to approximately the fold line 51, being primarily or entirely within section 2A.

One or more embodiments of a convertible ground cover and backpack 5 further comprise one or more coupling straps or connecting elements employed as waist belt straps 60. The waist belt straps 60 are typically coupled to the second side 17 of the tarp 10 such that a waist belt 70 may loop through the waist belt straps 60. Coupling of the waist belt straps 60 may be through stitching, adhesives, snap buttons, and the like.

The one or more waist belt straps 60 are typically positioned entirely or substantially within section 5A on second side 17 of the tarp 10 (between edge 12, fold line 50, fold line 53, and fold line 51). More particularly, the one or more waist belt straps 60 may be positioned as just described and proximate fold line 50. In the non-limiting embodiment shown in FIG. 6, the convertible ground cover and backpack 5 comprises three waist belt straps 60, or specifically: waist belt strap 61, waist belt strap 62, and waist belt strap 63. In other embodiments, a convertible ground cover and backpack 5 may comprise any number of waist belt straps 60.

Figure 7:
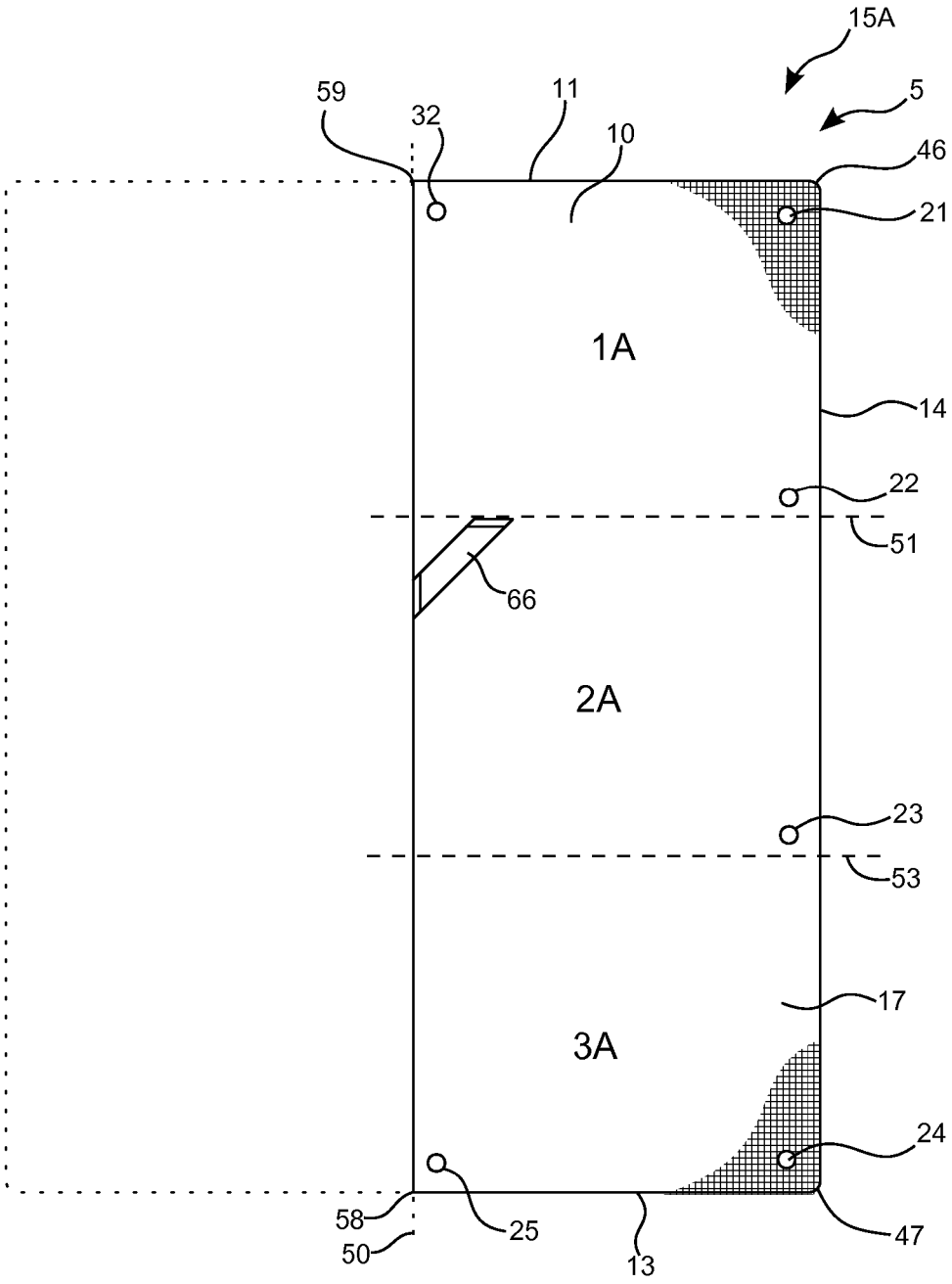
FIG. 7 depicts the tarp in the first folded position.

Also contemplated in this disclosure is a method of converting a ground cover 15A according to the above described embodiments to a backpack 15B. According to one aspect, a tarp 10 of a convertible ground cover and backpack 5 is spread out with the first or inner side 16 face down and the second or outer side 17 face up (as shown in FIGS. 2 and 6). The tarp 10 of the convertible ground cover and backpack 5 is folded underneath along the fold line 50 to a first folded position 100 wherein edge 12 and edge 14 are substantially adjacent one another, thereby bringing sections 1B-3B substantially adjacent sections 4B-6B. FIG. 7 depicts the tarp 10 in the first folded position 100. In the first folded position 100, the restraint 66 is typically face up. Furthermore, a first center corner 58 and a second center corner 59 are formed.

Folding tarp 10 into first folded position 100 shown in FIG. 7 may also be achieved where tarp 10 is spread out with the second or outer side 17 face down and the first or inner side 16 face up. Tarp 10 is then folded over along the fold line 50 to a first folded position 100 wherein edge 12 and edge 14 are substantially adjacent one another, thereby bringing sections 1B-3B substantially adjacent sections 4B-6B. Tarp 10 may be oriented such that restraint 66 is face up as shown in FIG. 7.

In one or more embodiments, a convertible ground cover and backpack 5 comprises grommets 31 and 32 proximate edge 11 and grommets 25 and 26 proximate edge 13. More particularly, the grommets 31 and 32 proximate edge 11 may be positioned proximate a center point between tarp corner 46 and tarp corner 49. Similarly, grommets 25 and 26 proximate edge 13 may be positioned proximate a center point between tarp corner 47 and tarp corner 48. Even more particularly, each pair of grommets 31/31 and grommets 25/26 may be positioned so that they are approximately coaxially aligned when tarp 10 is folded into the first folded position 100. Thus, grommet 32 is on top of grommet 31 and an appropriately sized object can pass through the voids of both grommets. Similarly, grommet 25 is on top of grommet 26 and an appropriately sized object can pass through the voids of both grommets.

In one or more embodiments, a convertible ground cover and backpack 5 comprises top edge 12 grommets 28 and 29. Grommets 28 and 29 are typically positioned approximately equal distance from each other and the nearest corner grommets (grommet 27 or 30) of the tarp 10. That is, a grommet 28 is typically positioned approximately ⅓ the distance between grommet 27 and grommet 30, and grommet 29 is typically positioned approximately ⅔ the distance between grommet 27 and grommet 30. In other embodiments, grommets 28 and 29 may be positioned elsewhere along the top edge 12 of the tarp 10 without departing from the scope of this disclosure. Typically, grommets 28 and 29 are equal distance from the nearest corner grommet (grommet 27 or 30).

Similarly, in one or more embodiments, a convertible ground cover and backpack 5 comprises bottom edge 14 grommets 23 and 22. Grommets 23 and 22 are typically positioned approximately equal distance from each other and the nearest corner grommets (grommet 24 and 21) of the tarp 10. That is, grommet 23 is typically positioned approximately ⅓ the distance between grommet 24 and grommet 21, and grommet 22 is typically positioned approximately ⅔ the distance between grommet 24 and grommet 21. In other embodiments, grommets 23 and 22 may be positioned elsewhere along the bottom edge 14 of the tarp 10 without departing from the scope of this disclosure. Typically, grommets 23 and 22 are equal distance from the nearest corner grommet (grommet 24 or 21). More particularly, grommets 28 and 23 and grommets 29 and 22 are typically aligned approximately coaxially with one another such that they are all equal distance from the nearest corner grommet.

Figure 8A:
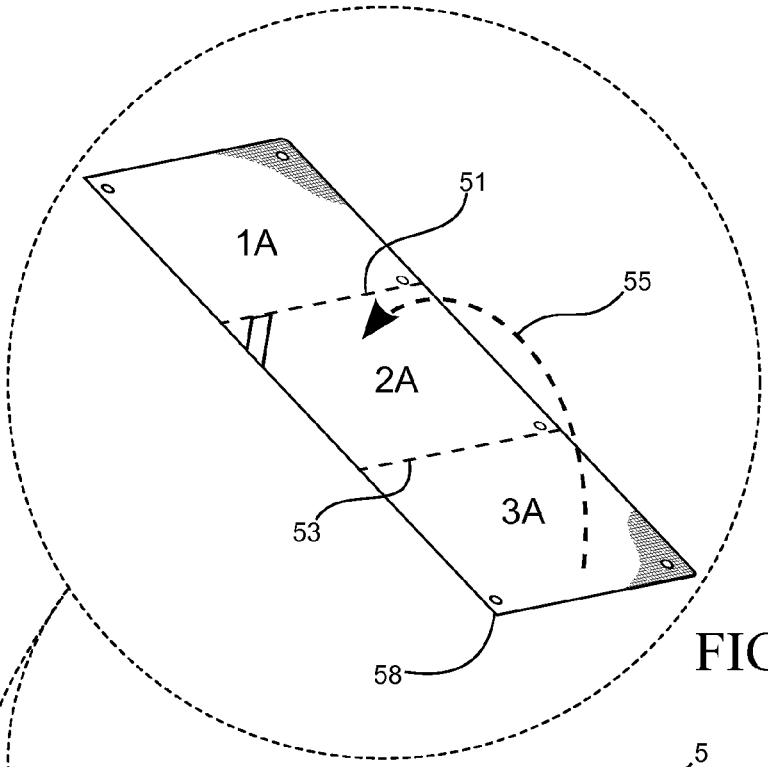
FIGS. 8A-B depict the tarp in the second folded position.
Figure 8B:
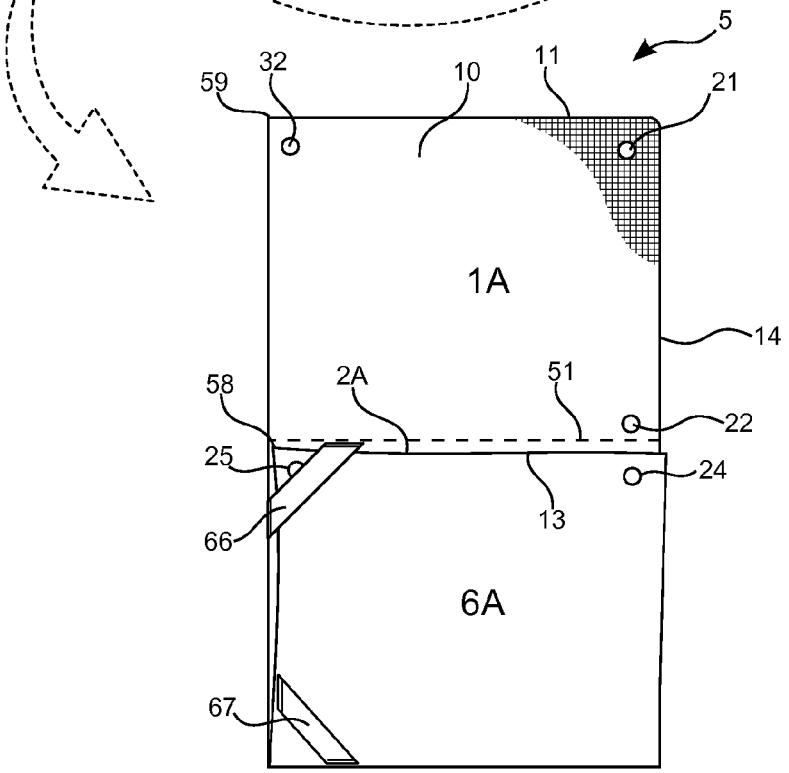

FIGS. 8A and 8B depict folding the tarp 10 in the second folded position 102. A method for converting a ground cover 15A to a backpack 15B further comprises folding (see second fold arrow 55) the tarp 10 along the fold line 53 to a second folded position 102 wherein edge 13 is adjacent fold line 51 and section 3A is approximately adjacent and mostly covering section 2A. FIG. 8B depicts the tarp 10 resting in the second folded position 102.

Once in the second folded position 102, a method for converting a ground cover 15A to a backpack 15B further comprises coupling the first center corner 58 to the restraint 66. Coupling of the first center corner 58 to the restraint 66 may comprise inserting the first center corner 58 into the opening of the restraint 66 between the coupling strap and the tarp 10.

Figure 9:
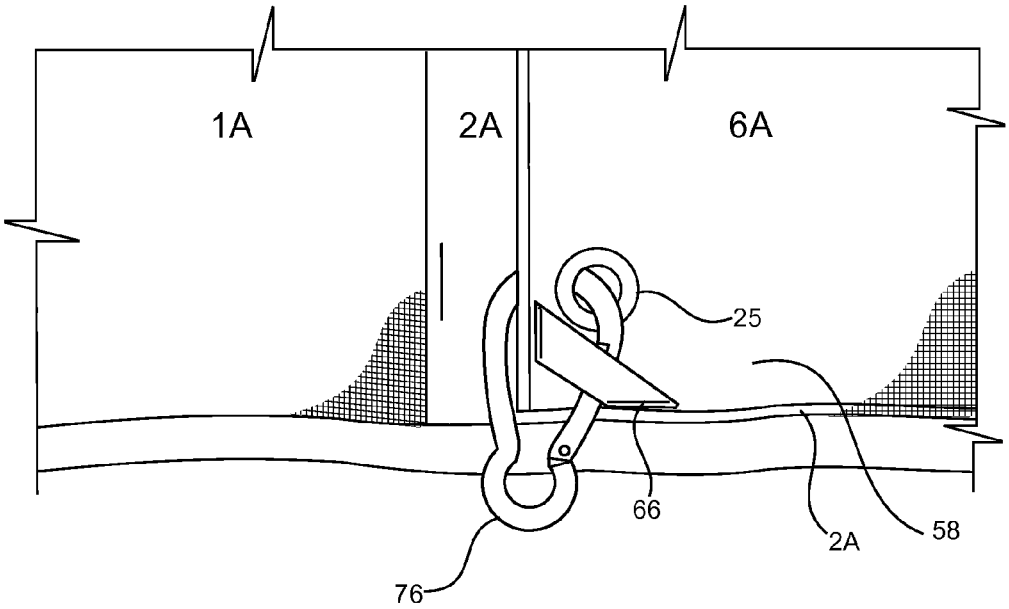
FIG. 9 depicts a close-up view of the tarp in the second folded position.

Referring to FIG. 9, according to some aspects, coupling the first center corner 58 to the restraint 66 further comprises coupling grommets 25 and 26 proximate the first center corner 58 to the restraint 66 with a fastener, such as a first carabiner 76. FIG. 9 depicts a close up view of a first carabiner 76 coupling grommets 25 and 26 of the first center corner 58 to the restraint 66.

Figure 10A:
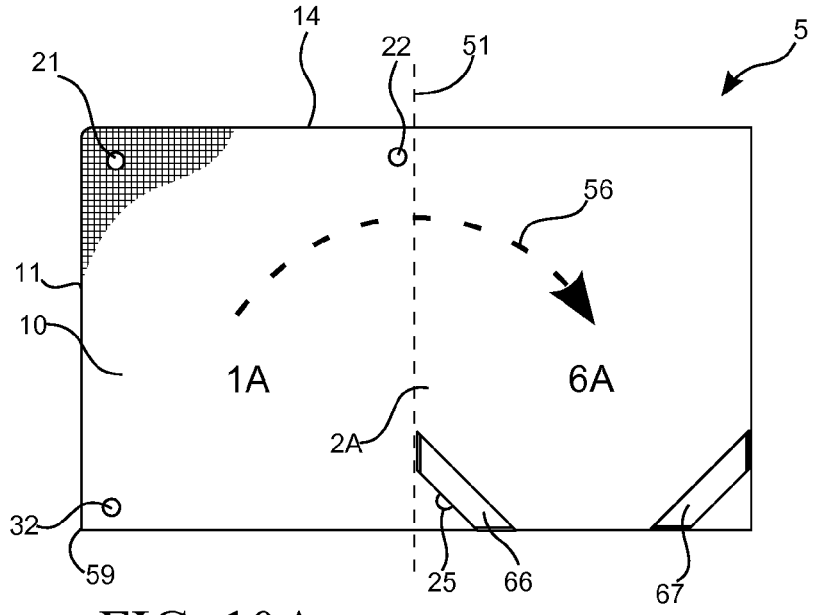
FIGS. 10A-B depict the tarp in the third folded position.
Figure 10B:
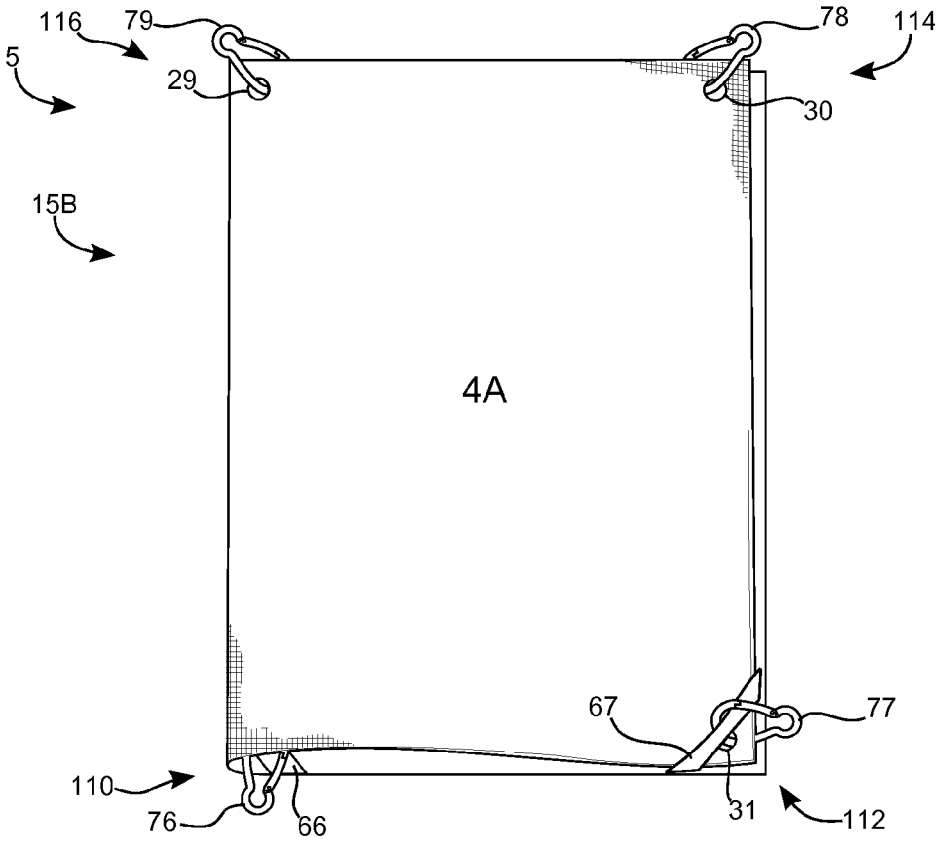

Referring to FIGS. 10A and 10B, a method for converting a ground cover 15A to a backpack 15B further comprises folding (see third fold arrow 56) the tarp 10 along the fold line 51 to a third folded position 104 wherein edge 11 is adjacent the fold line 53 and section 1A is approximately adjacent and mostly covering section 6A. FIG. 10B depicts the tarp 10 in the third folded position 104. In the third folded position 104, the second center corner 59 is proximate the restraint 67. In the third folded position 104, backpack 15B comprises backpack corners 110, 112, 114, and 116, as shown in FIG. 10B.

Once in the third folded position 104, a method for converting a ground cover 15A to a backpack 15B further comprises coupling the second center corner 59 to the restraint 67. Coupling of the second center corner 59 to the restraint 67 may comprise inserting the second center corner 59 into the opening of the restraint 67 between the coupling strap and the tarp 10.

According to some aspects, coupling the second center corner 59 to the restraint 67 further comprises coupling grommets 31 and 32 proximate the second center corner 59 to the restraint 67 with a second carabiner 77. FIG. 10B depicts a view of second carabiner 77 coupling the grommets 31 and 32 of the second center corner 59 to the restraint 67.

A method for converting a ground cover 15A to a backpack 15B further comprises coupling of the grommets proximate backpack corner 114 to each other and the grommets proximate backpack corner 114 to each other. Grommets 30, 21, 23 and 28 located proximate backpack corner 114 are approximately coaxially aligned and are coupled with a fastener, such as third carabiner 78. Similarly, grommets 29, 22, 27, and 24 located proximate backpack corner 116 are approximately coaxially aligned and are coupled with a fastener, such as fourth carabiner 79. Coupling of these grommets is typically removable coupling with carabiners 75, as shown in FIGS. 3 and 10B.

Figure 11:
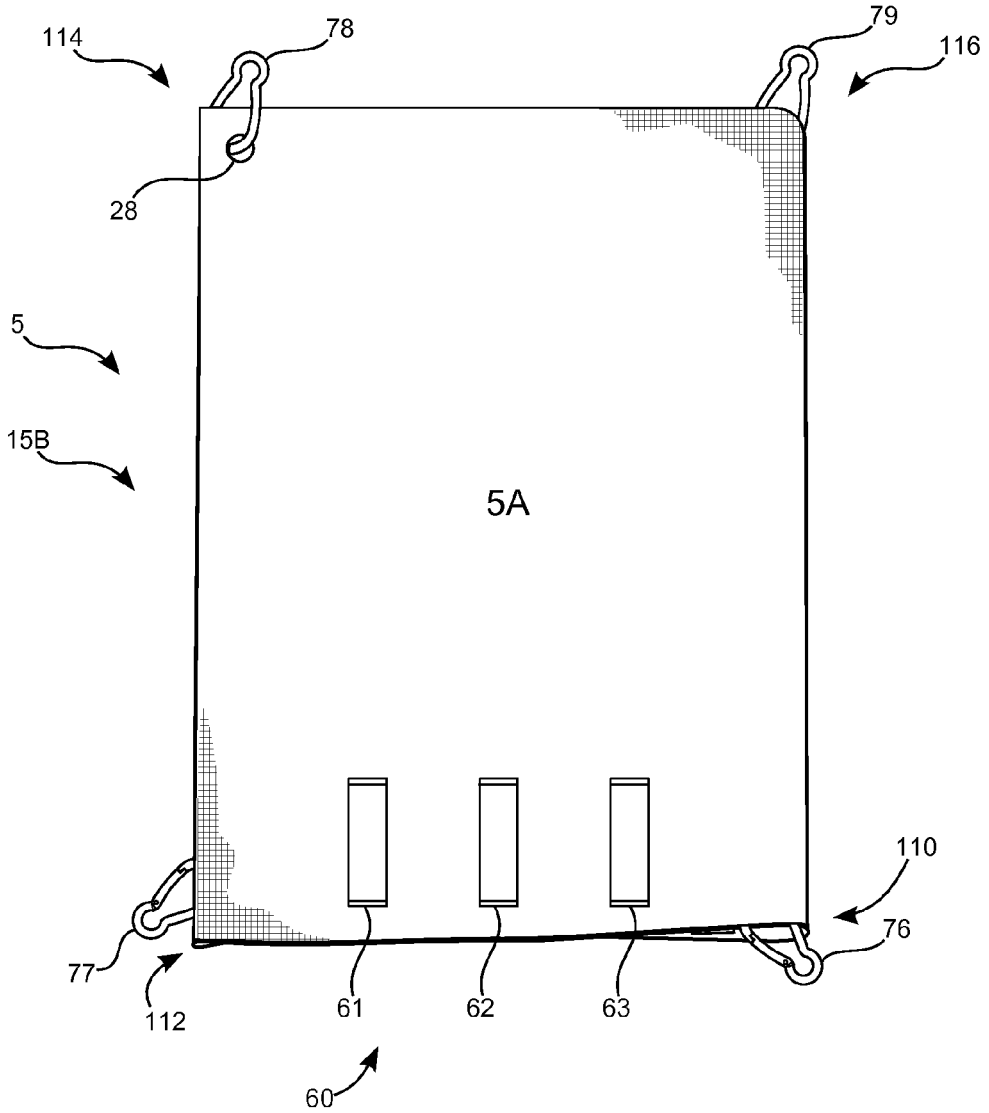
FIG. 11 depicts a first view of the backpack.

FIG. 11 depicts the tarp 10 of a convertible ground cover and backpack 5 in the third folded position 104 with the waist belt straps 60 (or 61-63) visible (showing section 5A facing up and section 4A facing down). According to some aspects, a method of converting a ground cover 15A to a backpack 15B comprises removably coupling a waist belt 70 to the one or more waist belt straps 60 on the tarp 10. Removably coupling the waist belt 70 to the one or more waist belt straps 60 typically comprises looping a waist belt 70 through the one or more waist belt straps 60.

Figure 12B:
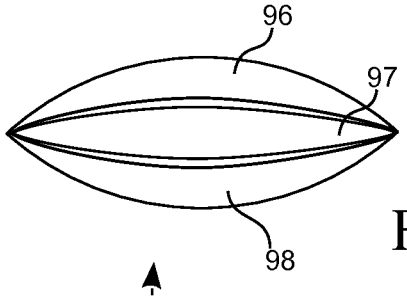
FIGS. 12A-B depict a second view of the backpack.
Figure 12A:
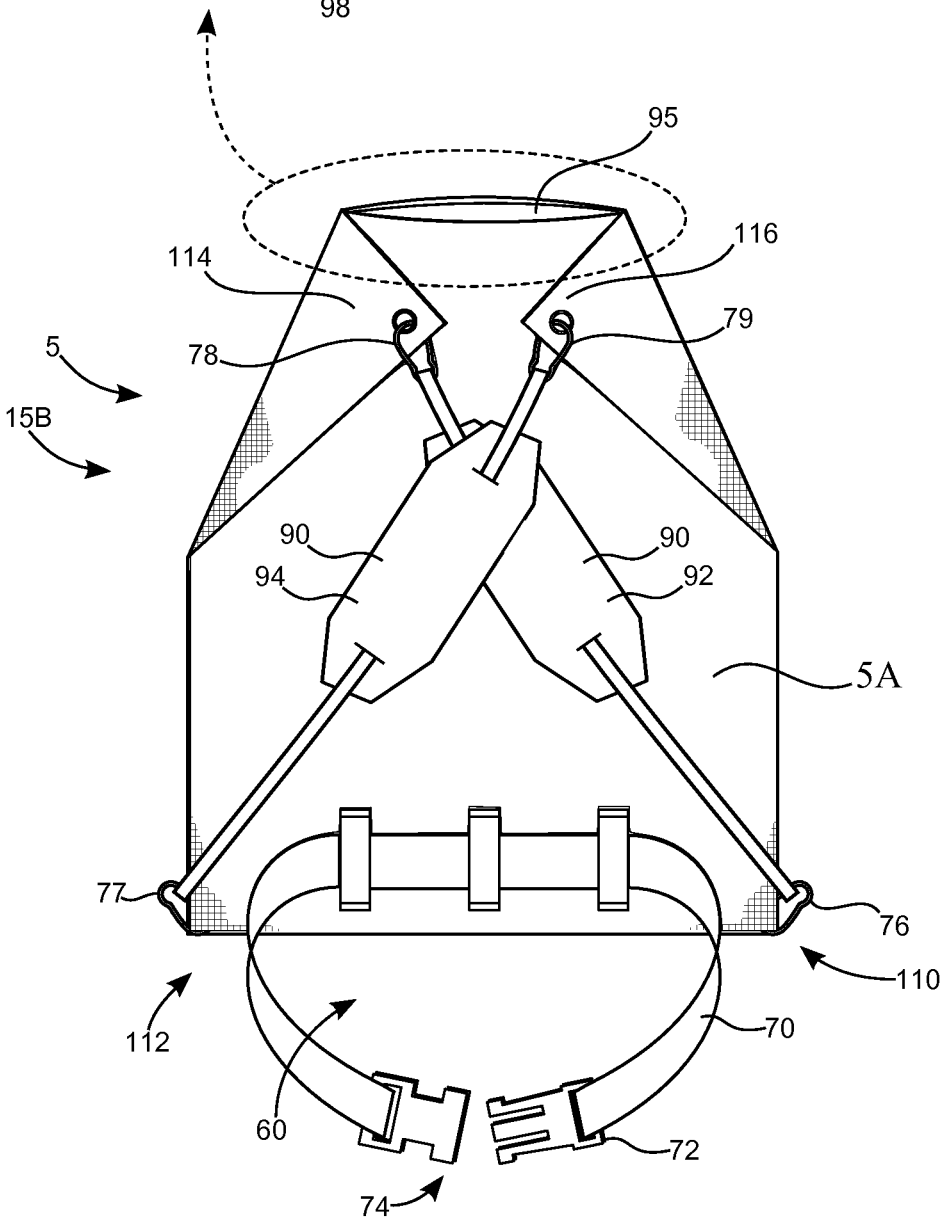

FIG. 12A depicts the tarp 10 of a convertible ground cover and backpack 5 in the third folded position 104 with the waist belt 70 coupled to the waist belt straps 60. A method of converting a ground cover 15A to a backpack 15B further comprises removably coupling one or more shoulder straps 90 to the tarp 10, typically when the tarp 10 is in the third folded position 104. According to some aspects, coupling one or more shoulder straps 90 to the tarp 10 comprises: coupling a distal portion of a first shoulder strap 92 to the first carabiner 76, which is already coupled to restraint 66 and grommets 25 and 26 at backpack corner 110; and coupling a proximate portion of the first shoulder strap 92 to the third carabiner 76, which is already coupled to grommets 21, 23, 28, and 30 at backpack corner 114. Coupling one or more shoulder straps 90 to the tarp 10 may further comprise: coupling a distal portion of a second shoulder strap 94 to the second carabiner 77, which is already coupled to restraint 67 and grommets 31 and 32 at backpack corner 112; and coupling a proximate portion of the second shoulder strap 94 to the fourth carabiner 79, which is already coupled to grommets 22, 24, 27, and 29 at backpack corner 116. According to some aspects, the two shoulder straps 90 form a cross or form an X when coupled to the tarp 10 in the third folded position 104.

FIG. 12A also shows a non-limiting embodiment of a waist belt 70. The waist belt 70 is typically configured to removably couple to the backpack 15 and/or a carry bag 130 as shown in FIG. 15C. The waist belt 70 may comprise a buckle 74 with one or more adjustable elements 72 that allow a user to adjust the length or circumference of the waist belt 70. According to some aspects, the waist belt 70 comprises a padded portion and a canvas portion.

In the third folded position 104 with the shoulder straps 90 coupled thereto, the tarp 10 typically forms a backpack 15B. According to some aspects, the formed backpack 15B comprises a plurality of pockets 95, as shown in FIG. 12B. In the non-limiting embodiment of FIGS. 12A-B, the backpack 15B formed according to the described method comprises three pockets 95: first pocket 96, second pocket 97, and third pocket 98. First pocket 96 is open at the top, has fold line 50 at the bottom, and is securely bound on both sides by fold lines 51 and 53. Second pocket 97 is open at the top, has fold line 50 at the bottom, is securely bound on one side by fold line 53, and loosely bound on the other side by fold line 51, which is adjacent but not attached. Third pocket 98 is open at the top, has fold line 50 at the bottom, is securely bound on one side by fold line 51, and unbound on the other side because side 11 leaves the third pocket 98 open to the exterior. Accordingly, first pocket 96 is the most secure pocket and third pocket 98 is the least secure pocket of pockets 96-98.

Figure 13:
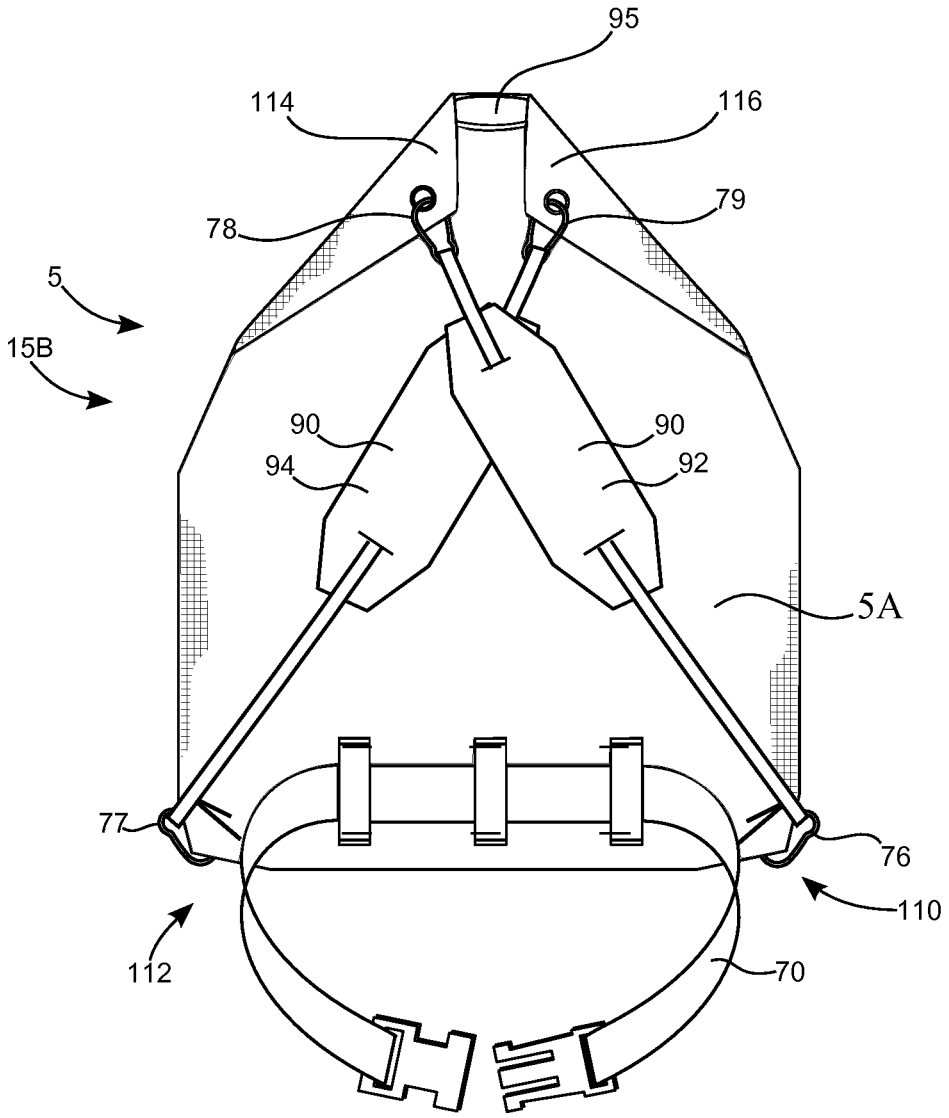
FIG. 13 depicts a third view of the backpack.

FIG. 12A depicts the tarp 10 after formation of a backpack 15B and with the shoulder straps 90 in a relaxed and unloaded position. In use, the shoulder straps 90 are typically drawn closer together until the pockets are unloaded, as shown in FIG. 13, thereby closing the top of pocket(s) 95 more securely.

Figure 14:
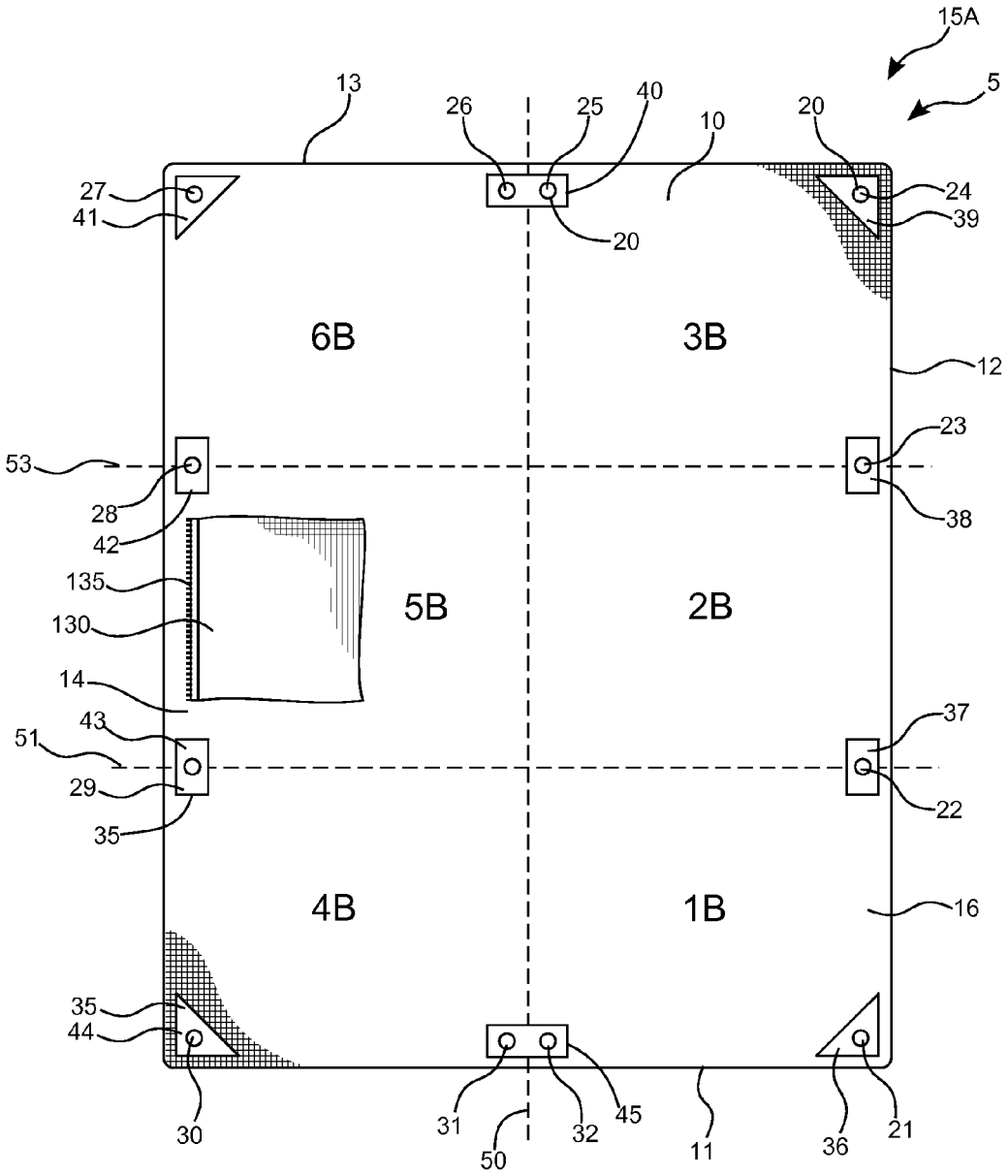
FIG. 14 depicts an implementation including a carry bag.
Figure 15A:
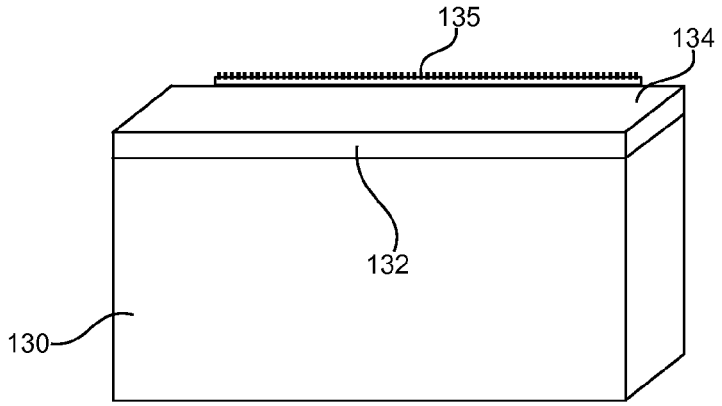
FIGS. 15A-C depict various implementations of a carry bag.
Figure 15B:
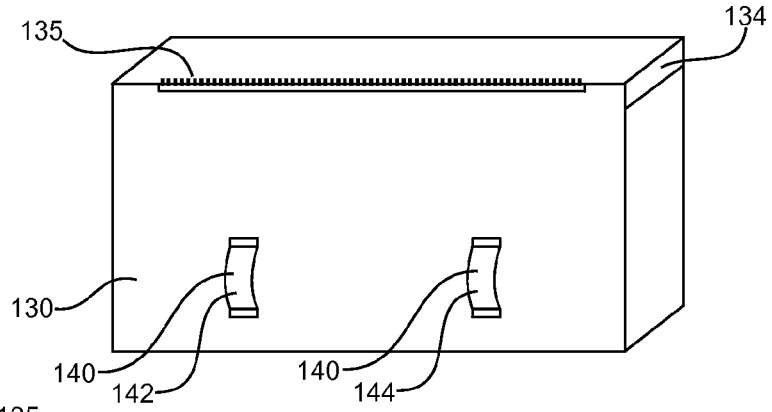
Figure 15C:
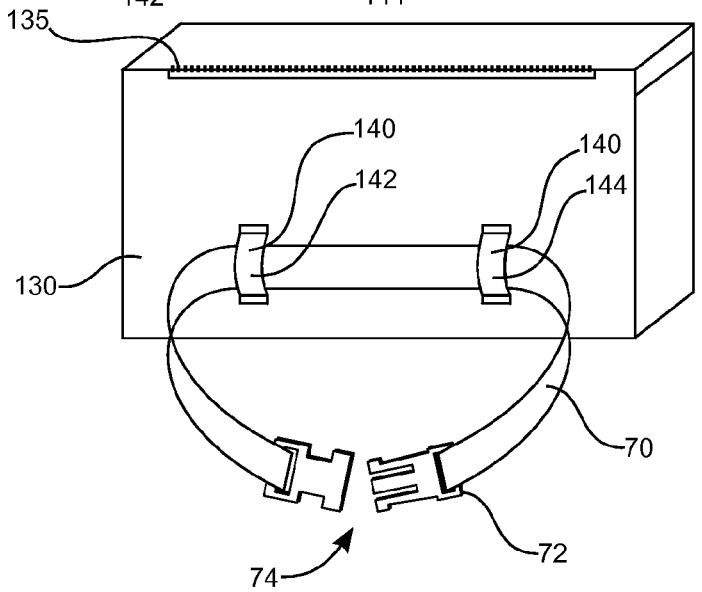

FIGS. 14 and 15A-C depict various aspects of a carry bag 130. According to some aspects a convertible ground cover and backpack 5 comprises a carry bag 130 configured to removably couple to the tarp 10. Typically, the carry bag 130 is configured to removably couple to the tarp 10 proximate top edge 14 of the tarp 10, and may be positioned to fit within one of pockets 96-98. In other embodiments, however, the carry bag 130 is configured to removably couple to other areas of the tarp 10 in addition or alternative to top edge 14, such as but not limited to a side edges 11 or 13, the bottom edge 12, the first side 16 of the tarp 10, and/or the second side 17 of the tarp 10. Removably coupling of the carry bag 130 to the tarp 10 may be with any suitable removable coupling mechanism 135 known in the art, such as but not limited to zippers, Velcro material, snap buttons, buttons, magnets, and the like. In FIG. 14, the carry bag 130 is shown removably coupled to the top edge 14 of the tarp 10. FIGS. 15A-C provide a more detailed view of the carry bag 130 removed from the tarp 10.

FIGS. 15A-C depict a non-limiting embodiment of a carry bag 130 configured to removably couple to the tarp 10 of a convertible ground cover and backpack 5. According to some aspects, the carry bag 130 comprises snaps, a zipper, or other coupling mechanism 132 that allows for opening and closing of the carry bag 130 using lid 134. The carry bag 130 may further comprise at least one carry bag strap 140 configured to removably couple the carry bag 130 to a waist belt 70. In the non-limiting embodiment shown in FIGS. 15A-C, the carry bag 130 comprises two carry bag straps (142 and 144) coupled to the carry bag 130 such that the portions of the waist belt 70 may slide between the carry bag straps 142 and 144 and the carry bag 130. The carry bag straps 140 are comprised of any suitable material known in the art, such as but not limited to canvas, elastic, plastic, leather, and the like.

According to some non-limiting embodiments, a convertible ground cover and backpack 5 may also include various items that may be included in a kit for a convertible ground cover and backpack 5. According to some aspects, a convertible ground cover and backpack 5 kit may comprise one or more of the following: a tarp 10, a carry bag 130, shoulder straps 90, a waist belt 70, a plurality of carabiners 75, a saw, sanitary items, bag, a rope, a flashlight, a knife, and the like. More particularly, a convertible ground cover and backpack 5 kit may comprise a tarp 10, two adjustable shoulder straps 90, a waist belt 70, a carry bag 130, and a plurality of carabiners 75. Still other embodiments of a convertible ground cover and backpack 5 kit may comprise other outdoor items.

Figure 16:
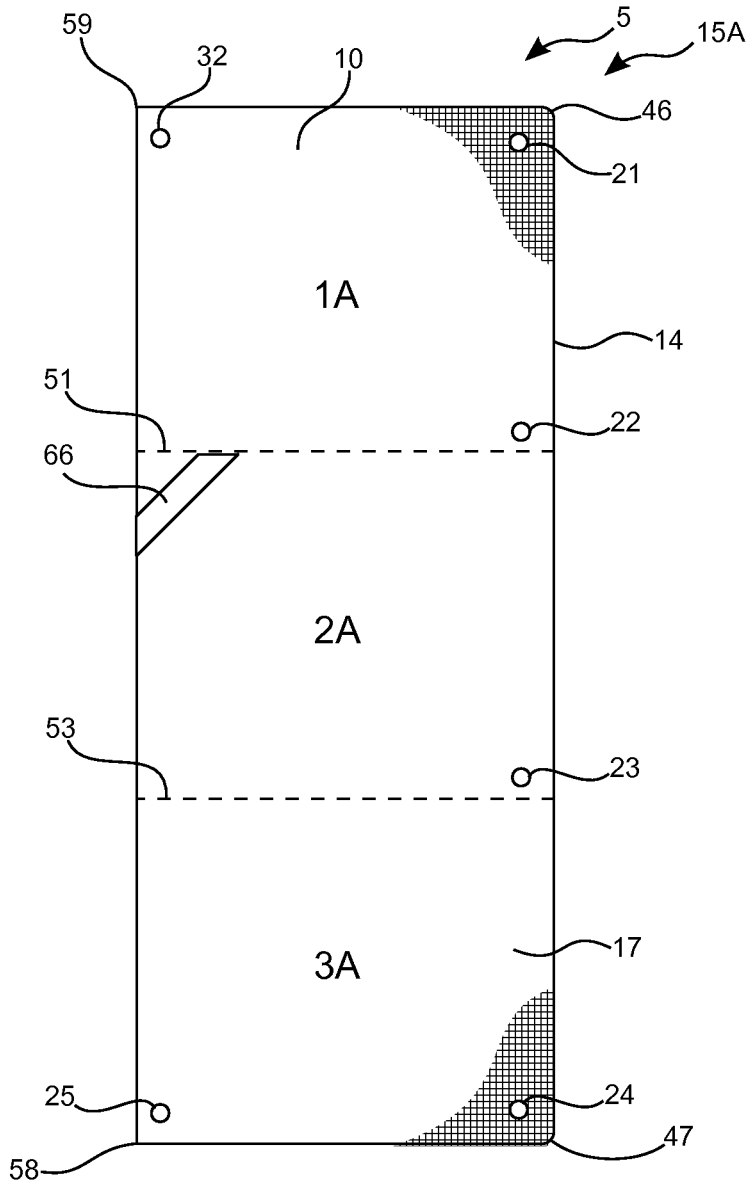
FIG. 16 depicts the tarp in the first folded position.
Figure 17:
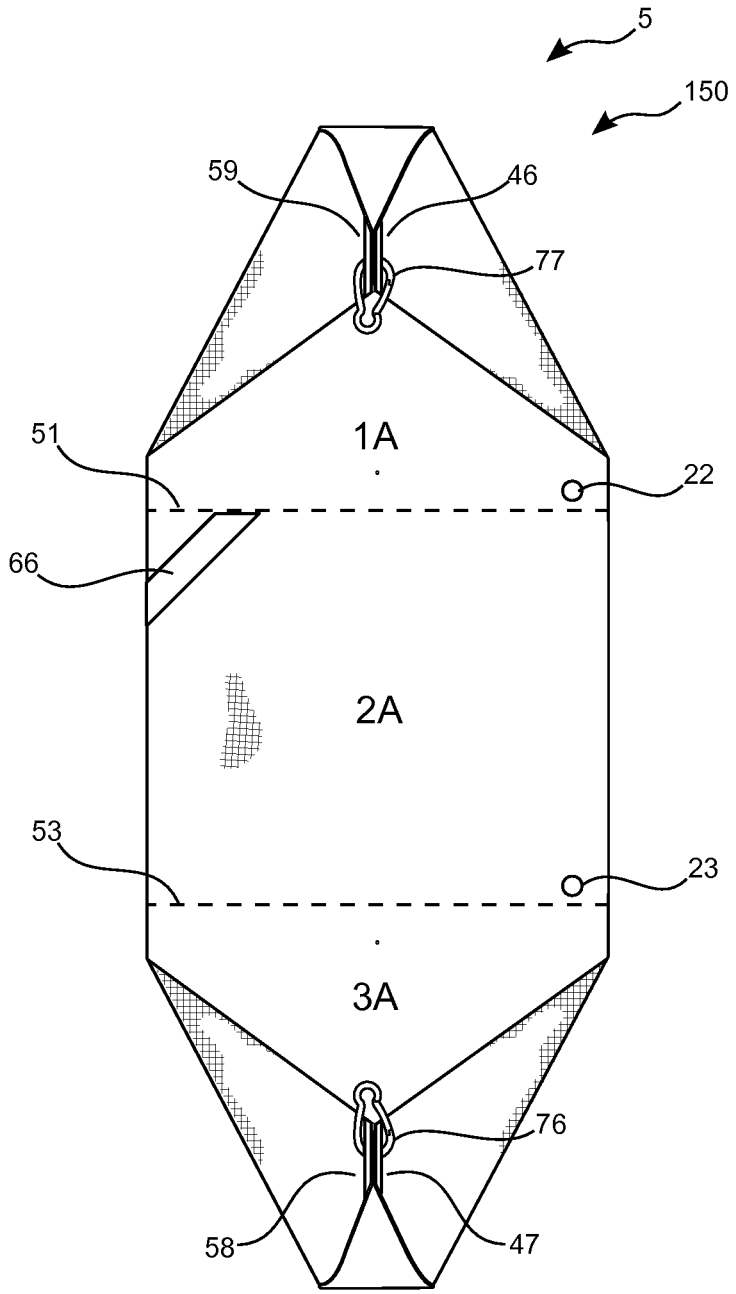
FIG. 17 depicts the ground cover converted into a hammock.

FIGS. 16 and 17 depict embodiments where tarp 10 is converted into a hammock 150. Also contemplated herein is a ground cover 15A that is convertible to not only a backpack 15B, but also to a hammock 150 as well as a method for converting a ground cover 15A to a hammock 150. According to one aspect, a method for converting a ground cover 15A to a hammock 150 comprises folding the tarp 10 according to embodiments disclosed herein to a first folded position 100. FIG. 16 depicts the tarp 10 in a first folded position 100.

A method for converting a ground cover 15A to a hammock 150 further comprises: coupling grommets 25 and 26 of the first center corner 58 to grommets 24 and 27 of corner 47 with a first carabiner 76; and coupling grommets 31 and 32 of the second center corner 59 to grommets 21 and 30 of corner 46 with a second carabiner 77. FIG. 17 depicts this coupling of the first and second carabiners 76 and 77 as described to form a hammock 150 from a ground cover 15A.

Any dimensions presented in this document are for example only and not a limitation on the scope of this disclosure. It will be understood that implementations are not limited to the specific components disclosed herein, as virtually any components consistent with the intended operation of a method and/or system implementation for ground cover may be utilized. Accordingly, for example, although particular tarp 10 materials, grommets 20, and couplings may be disclosed, such components may comprise any shape, size, style, type, model, version, class, grade, measurement, concentration, material, weight, quantity, and/or the like consistent with the intended operation of a method and/or system implementation for a convertible ground cover and backpack 5 may be used.

Accordingly, the components defining any convertible ground cover and backpack 5 implementation may be formed of any of many different types of materials or combinations thereof that can readily be formed into shaped objects provided that the components selected are consistent with the intended operation of a convertible ground cover and backpack 5 implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

Various convertible ground cover and backpack 5 implementations may be manufactured using conventional procedures as added to and improved upon through the procedures described here. Some components may be manufactured simultaneously and integrally joined with one another, while other components may be purchased pre-manufactured or manufactured separately and then assembled with the integral components.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g., a bolt, a nut, a screw, a nail, a rivet, a pin, and/or the like), wiring, any combination thereof, and/or the like for example, depending on, among other considerations, the particular material forming the components.

Upon reading the teachings of this specification, those with ordinary skill in the art will appreciate that, under certain circumstances, considering issues such as changes in technology, user requirements, etc., a variety of fastening devices may be used to "affix", "couple", and/or "releasably couple" (as those words are used herein) one or more components of the present disclosure. These fastening devices may include one or more of the following: adhesives, belts, bolts, buckles, clasps, latches, locks, screws, snaps, clamps, connectors, couplings, ties, or other fastening means yet to be developed.

Likewise, upon reading the teachings of this specification, those with ordinary skill in the art will appreciate that, under certain circumstances, considering issues such as changes in technology, subject requirements, etc., a variety of fastening devices, such as adhesives, belts, bolts, buckles, clasps, latches, locks, screws, snaps, clamps, connectors, couplings, ties or other fastening means yet to be developed may be used in lieu of—or in conjunction with—any of the fasteners or fastening means discussed above.

It will be understood that the assembly of a convertible ground cover and backpack 5 implementations are not limited to the specific order of steps as disclosed in this document. Any steps or sequence of steps of the assembly of a convertible ground cover and backpack 5 implementations indicated herein are given as examples of possible steps or sequence of steps and not as limitations, since various assembly processes and sequences of steps may be used to assemble convertible ground cover and backpack 5 implementations.

In places where the description above refers to particular implementations, it should be readily apparent that a number of modifications may be made without departing from the spirit thereof and that these implementations may be applied to other implementations disclosed or undisclosed. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

Further implementations are within the claims.

What is claimed is:

1. A backpack, comprising:

a tarp configured to be folded and having a first, second, and third fold line, wherein the second and third fold lines are substantially parallel to each other and the second and third fold lines are substantially orthogonal to the first fold line;

a first fastener coupled to a first corner of the folded tarp;

a second fastener coupled to a second corner of the folded tarp;

a first shoulder strap having a distal portion coupled to the first fastener and a proximate portion coupled to the second fastener;

a first pocket defined by the first, second, and third fold lines;

a third fastener coupled to a third corner of the folded tarp;

a fourth fastener coupled to a fourth corner of the folded tarp;

a second shoulder strap having a distal portion coupled to the third fastener and a proximate portion coupled to the fourth fastener;

a first and fourth edge substantially parallel to the first fold line;

a second and third edge substantially parallel to the second and third fold lines, wherein the second edge is proximate the second fold line, and the third edge is proximate the third fold line;

a plurality of grommets located proximate at least two of the first, second, third, or fourth edges;

a first restraint fixedly attached to the tarp proximate the first corner, wherein the first fastener is coupled to the first restraint and a grommet proximate the first corner; and a second restraint fixedly attached to the tarp proximate the third corner, wherein the second fastener is coupled to the second restraint and a grommet proximate the third corner.

2. The backpack of claim 1, wherein the first and second restraints comprise straps having distal and proximate portions fixedly attached to the tarp.

3. The backpack of claim 1, further comprising a carry bag coupled to the tarp proximate the first, second, third, or fourth edges, wherein the carry bag has an internal volume of less than 0.6 cubic feet and is configured to house the tarp.

4. The backpack of claim 3, further comprising a connecting element coupled to the carry bag, the connecting element being configured to couple with a waist belt.

5. The backpack of claim 1, further comprising:

a second pocket defined by the first fold line, the third fold line, and the third edge; and a third pocket defined by the first fold line, the second fold line, and the second edge.

6. The backpack of claim 1, further comprising a plurality of reinforcement sheets fixedly attached to the tarp, wherein each of the grommets intersects a reinforcement sheet and the tarp.

7. A backpack, comprising:

a tarp configured to be folded along a first, second, and third fold line such that, when folded, the tarp comprises: a first corner and a second corner proximate the first fold line, a fourth corner and the first corner proximate the second fold line, and a third corner and the second corner proximate the third fold line;

a first restraint fixedly attached to the tarp proximate the first corner;

a second restraint fixedly attached to the tarp proximate the second corner;

a plurality of grommets fixedly attached to the tarp;

a first fastener coupled to the first restraint and a grommet proximate the first corner;

a second fastener coupled to the second restraint and a grommet proximate the second corner;

a third fastener coupled to at least two grommets proximate the third corner;

a fourth fastener coupled to at least two grommets proximate the fourth corner;

a first shoulder strap having a distal portion coupled to the first fastener and a proximate portion coupled to the third fastener; and a second shoulder strap having a distal portion coupled to the second fastener and a proximate portion coupled to the fourth fastener.

8. The backpack of claim 7, further comprising a connecting element coupled to the tarp generally between and proximate the first and second corners, the connecting element being configured to couple with a waist belt.

9. The backpack of claim 7, further comprising a plurality of reinforcement sheets fixedly attached to the tarp, wherein each of the grommets intersects a reinforcement sheet and the tarp.

10. The backpack of claim 7, wherein the first and second restraints comprise straps having distal and proximate portions fixedly attached to the tarp.

11. The backpack of claim 7, further comprising a carry bag coupled to the tarp, wherein the carry bag has an internal volume of less than 0.6 cubic feet and is configured to house the tarp.

12. The backpack of claim 7, further comprising:

a first pocket defined by the first, second, and third fold lines.

13. A method of converting a tarp to a backpack, comprising:

folding the tarp along a first fold line, wherein the tarp comprises:

a first and fourth edge substantially parallel to the first fold line;

a second fold line substantially orthogonal to the first fold line;

a third fold line substantially parallel to the second fold line;

a second and third edge substantially parallel to the second and third fold lines, wherein the second edge is proximate the second fold line, and the third edge is proximate the third fold line; and a plurality of grommets located proximate at least two of the first, second, third, or fourth edges;

folding the tarp along the third fold line, thereby bringing the third edge proximate the second fold line, and placing a portion of the tarp beneath a first restraint;

folding the tarp along the second fold line, thereby bringing the second edge proximate the third fold line, and placing a portion of the tarp beneath a second restraint;

coupling a first fastener to the first restraint and a grommet;

coupling a second fastener to the second restraint and a grommet;

coupling a third fastener to at least two grommets proximate the third fold line and the first, second, and fourth edges; and coupling a fourth fastener to at least two grommets proximate the second fold line and the first, third, and fourth edges.

14. The method of claim 13, further comprising:

coupling a first shoulder strap having a distal portion coupled to the first fastener and a proximate portion coupled to the third fastener; and coupling a second shoulder strap having a distal portion coupled to the second fastener and a proximate portion coupled to the fourth fastener.

15. The method of claim 14, wherein the tarp is configured to fold into a hammock by folding the tarp along the first fold line, coupling a fifth fastener to at least two grommets proximate the second edge, and coupling a sixth fastener to at least two grommets proximate the third edge.

* * * * *